US007101156B1

(12) United States Patent
Davis

(10) Patent No.: US 7,101,156 B1
(45) **Date of Patent: *Sep. 5, 2006**

(54) METHOD AND APPARATUS FOR CONTROLLING A PUMPING UNIT

(76) Inventor: Jeffrey Davis, P.O. Box 509, La Plata, NM (US) 87418

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 1034 days.

(21) Appl. No.: 09/334,208

(22) Filed: Jun. 15, 1999

(51) Int. Cl.

| | |
|---|---|
| ***F04B 35/00*** | (2006.01) |
| ***F04B 49/00*** | (2006.01) |
| ***F04B 17/00*** | (2006.01) |
| ***E21B 43/00*** | (2006.01) |

(52) U.S. Cl. ..... 417/319; 417/223; 417/53; 417/364; 166/68.5

(58) Field of Classification Search ..... 417/223, 417/319, 53, 364; 166/68.5
See application file for complete search history.

(56) References Cited

U.S. PATENT DOCUMENTS

| | | | | | |
|---|---|---|---|---|---|
| 2,634,682 | A | * | 4/1953 | Dye | 103/22 |
| 3,075,467 | A | * | 1/1963 | Gallaway | 103/44 |
| 3,247,798 | A | * | 4/1966 | Glasgow et al. | 103/6 |
| 3,851,995 | A | * | 12/1974 | Mills | 417/12 |
| 3,893,525 | A | * | 7/1975 | Dower et al. | 173/3 |
| 4,318,674 | A | * | 3/1982 | Godbey et al. | 417/36 |
| 4,384,827 | A | * | 5/1983 | Miller et al. | 417/223 |
| 4,390,321 | A | * | 6/1983 | Langlois et al. | 417/15 |
| 4,392,782 | A | * | 7/1983 | Kuehn, III et al. | 417/36 |
| 4,450,943 | A | * | 5/1984 | Long, Jr. | 192/70.2 |
| 4,493,613 | A | * | 1/1985 | Sommer | 417/15 |
| 4,958,713 | A | * | 9/1990 | Latsko | 192/88 B |
| 4,997,346 | A | * | 3/1991 | Bohon | 417/319 |
| 5,064,349 | A | * | 11/1991 | Turner et al. | 417/53 |
| 5,251,696 | A | * | 10/1993 | Boone et al. | 166/250 |

* cited by examiner

*Primary Examiner*—Charles G. Freay
*Assistant Examiner*—Timothy P. Solak

(57) ABSTRACT

Method and apparatus for reducing the pumping duty cycle of a pump assembly associated with an oil, natural gas, or water well with a concomitant reduction in the wear associated with the pump down hole components. An engine is connected with a pump assembly through a pneumatically actuated clutch and a selected event is determined to actuate the clutch to connect the engine with the pump assembly. The selected events may be a timed cycle determined from observations or a direct determination of liquid level in the well bore so that hydrocarbon production is maintained from the well bore. A pressurized gas is supplied on the occurrence of the selected event to actuate the clutch to connect the pump assembly with the engine to remove liquid from the gas well to maintain hydrocarbon production from the well.

9 Claims, 2 Drawing Sheets

METHOD AND APPARATUS FOR CONTROLLING A PUMPING UNIT

FIELD OF THE INVENTION

This invention is directed to oil and gas field pumping units, and, more particularly, to control systems for minimizing the run time to reduce wear on the pumping unit and associated pump rods and tubing.

BACKGROUND OF THE INVENTION

Oil and gas field pumping units conventionally convert a rotary motion from an electric or gas powered engine to a vertical reciprocating motion for moving a subsurface pump and sucker rods in a tubing string for vertically removing liquid from an oil, gas, or water bearing formation. The subsurface pumps typically employ a series of lift check valves within a tubing string to cause vertical movement of liquid within the tubing string. But the check valves seal against and move relative to the tubing string so that there is substantial wear of the down hole components. This wear is increased when a tubing string and associated cased well bore are not perfectly vertical, but have significant amounts of deviation from vertical, i.e., the casing is "crooked".

In an oil and gas field, the fluid level in the casing-tubing annulus must be maintained at some minimum depth in order to reduce the hydrostatic head of the fluid in the casing-tubing string and enable the oil, gas, and water to enter the casing. Typically, the subsurface pump is sized to pump more volume of liquid than will enter the well bore over time so that a pump does not have to pump continuously to maintain a selected fluid level between selected elevations, i.e., to maintain a selected maximum hydrostatic head. Thus, continuous pumping unnecessarily aggravates wear in the surface and down hole pumping unit system components.

It will be appreciated that replacing down hole components as a result of wear is expensive and time consuming since the entire pump string must be removed and refurbished. For example, if the duty cycle of a pumping unit is reduced by a factor of four, the replacement cycle period for down hole components is increased by a factor of four with a substantial reduction in costs and increase in well utilization.

Pumping units typically may be powered by electric motors or by natural gas powered engines. Where electric motors are used, the motor may be simply turned on and off according to a predetermined cycle to control the pumping cycle and concomitant liquid level. But in remote locations where engines are used, it is not desirable to turn the engines on and off because of reliability problems, reduced battery life under repeated start cycles, and the labor needed to periodically return to a pump site. Until the present invention, there has not been a suitable control system for providing a reliable duty cycle from pumps using natural gas engines.

Various objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, this invention provides a method for reducing the pumping duty cycle of a pump assembly associated with a pumping oil, natural gas, or water well. An engine is connected with a pump assembly through a pneumatically actuated clutch and a selected event is determined to actuate the clutch to connect the engine with the pump assembly. A pressurized gas is supplied on the occurrence of the selected event to actuate the clutch to connect the pump assembly with the engine to remove liquid from the gas well to maintain an inflow of hydrocarbons from the producing formation.

In another characterization of the present invention, a pumping assembly maintains gas flow from a gas well or oil production from an oil well. A pumping assembly pumps liquid from the gas well with an engine for driving the pumping assembly, where a pneumatic clutch connects the engine with the pumping assembly. A control unit actuates the pneumatic clutch when needed to pump liquid from the gas well to maintain an inflow of hydrocarbons from the producing formation.

BRIEF DESCRIPTION OF THE DRAWINGS

The accompanying drawings, which are incorporated in and form a part of the specification, illustrate the present invention and, together with the description, serve to explain the principles of the invention. In the drawings.

DETAILED DESCRIPTION

In accordance with the present invention, a gas actuated clutch is used to connect a natural gas powered engine to a pumping unit to cycle the pumping unit as needed to maintain a fluid level in a borehole between selected elevations and maintain a sustained inflow of hydrocarbons from the producing formation. The actuating gas is preferably natural gas from the well so that the actuating component is conveniently available at the well site.

Figure 1:
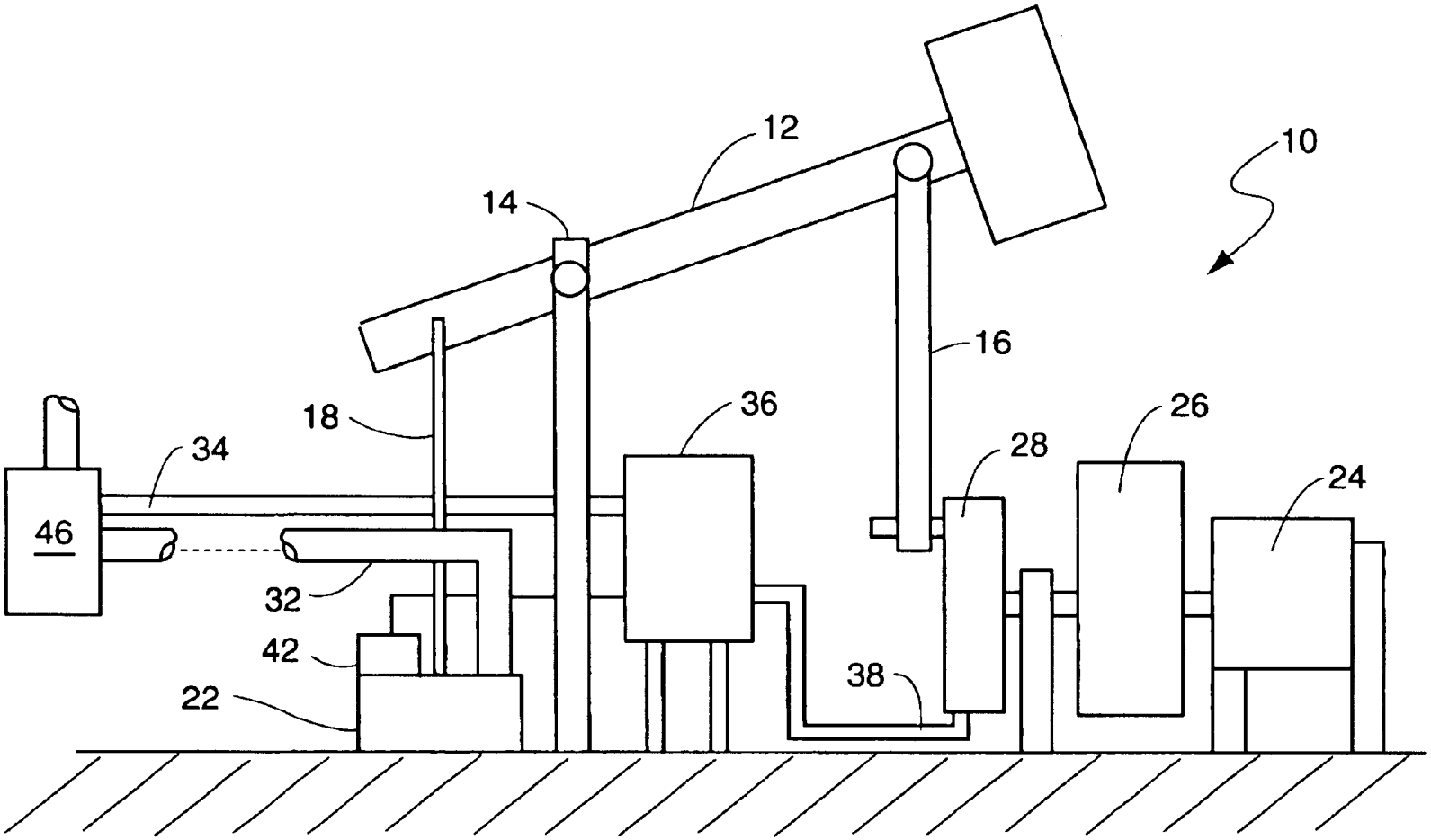
FIG. 1 is a pictorial illustration of a controlled pumping unit according to the present invention.

FIG. 1 is a pictorial illustration of one embodiment of the present invention. Pump unit 10 is comprised of a pump having lever arm 12, support pivot 14, crank arm 16 and sucker rods 18. Crank arm 16 operates as a conventional crank shaft and converts rotary motion from pneumatic clutch 28 to reciprocating motion for vertically pivoting lever arm 12 about support pivot 14 and vertically move attached sucker rods 18. Internal borehole pump configurations are well known and are not described herein.

Liquid, usually oil and water, is removed from the borehole and collected by associated piping and tanks (not shown) for periodic collection and sale or disposal. FIG. 1 shows the power components (clutch 28, flywheel 26, and engine 24) in-line with the pump components for ease of depiction. Usually the power components are perpendicular to the pump components to simplify the connection of crankshaft 16 to lever arm 12. It will be appreciated that the configuration of the engine drive components in FIG. 1 is only exemplary and many different arrangements of the components may be made and still achieve the advantages of the present invention.

Clutch 28 is powered by engine 24. In one embodiment, flywheel 26 is interposed between engine 24 and clutch 28 to smooth the rotary motion of clutch 28 when connected to crankshaft 16 so that a smooth vertical motion is imparted to sucker rods 18. Engine 24 is preferably powered by natural gas from dryer 46, but another gas supply might be provided.

Natural gas from the well borehole exits through gas outlet 32 and may pass through a dryer 46 for removing entrained liquid in the gas. The gas is pressurized and pumps are not required for creating a flow of the gas. Most of the gas exits dryer 46 for collection and sale, but some of the gas is returned through a manifold line 34 to power engine 24 and, in accordance with the present invention, to control unit 36 through line 38 to actuate pneumatic clutch 28.

Control unit 36 acts to provide gas for engaging clutch 28 to connect engine 24 with crank arm 16. Thus, pumping action can be on a periodic basis as needed to keep a maximum fluid hydrostatic head within the borehole and to maintain a flow of natural gas. Control unit 36 may be a simple timer unit that is powered by a remote power supply such as batteries, photovoltaic cells, and the like, or using a battery that is charged by a generator (not shown) connected to engine 24. The timing cycle may be set manually by observing the rate of accumulation of fluid in the borehole and adjusting the duty cycle of pumping unit 10 to maintain a fluid elevation between selected limits.

In another embodiment, the actual fluid level in the casing is monitored directly by, e.g., liquid level monitor 42, which may use sonic transducers, radar, or light to interrogate the liquid surface level. A suitable liquid level monitor 42 is sold under the tradename Echo Meter. Now, clutch 28 is engaged whenever the fluid level in the casing-tubing annulus actually reaches a predetermined minimum height and is disengaged when the fluid level is pumped down to a predetermined depth.

Figure 2:
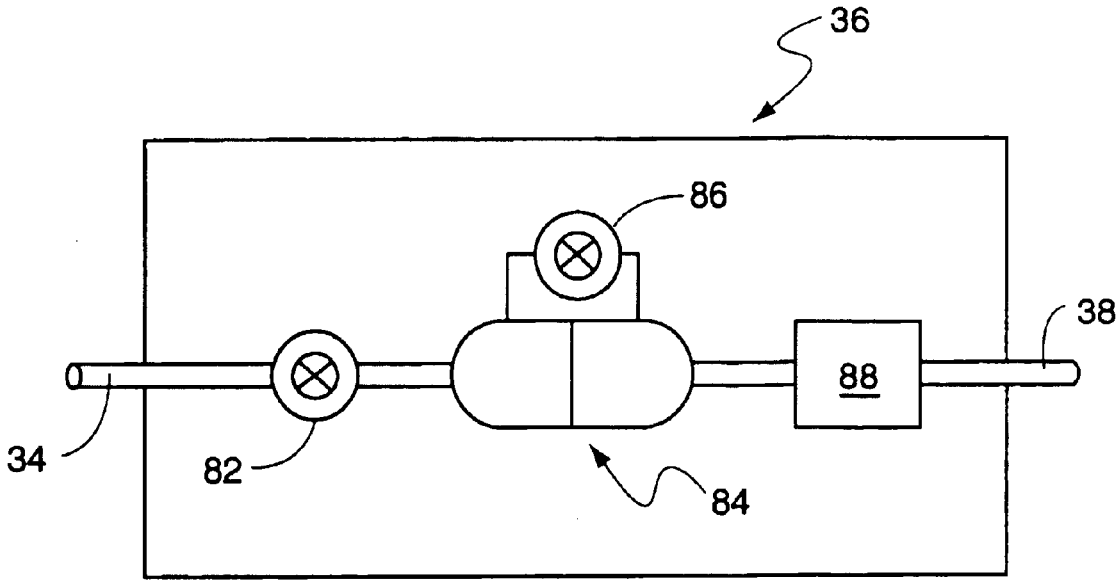
FIG. 2 is a schematic of an exemplary control system for actuating a pumping unit.

For either a timing unit or a level monitoring unit, a simple arrangement of solenoid valve or valves is actuated to supply gas to pneumatic clutch 28 or to exhaust gas from pneumatic clutch 28. Circuitry for actuating solenoid valves in response to a signal from a clock circuit or from a level monitor is well known and an exemplary embodiment is shown in FIG. 2. Natural gas from the well head is provided to control unit 36 through input line 34. A first, coarse regulator 82 provides a regulated gas pressure to volume pot 84, which accumulates high pressure gas and then supplies low pressure gas through second, fine regulator 86 in sufficient volume to actuate the pneumatic clutch 28 (FIG. 1). Solenoid 88 is actuated to provide gas to clutch 28 through line 38 or to exhaust gas from clutch 28. Solenoid 88 may be timer controlled or may be controlled by liquid level monitor 42 (FIG. 1) on well head 22.

Figure 3:
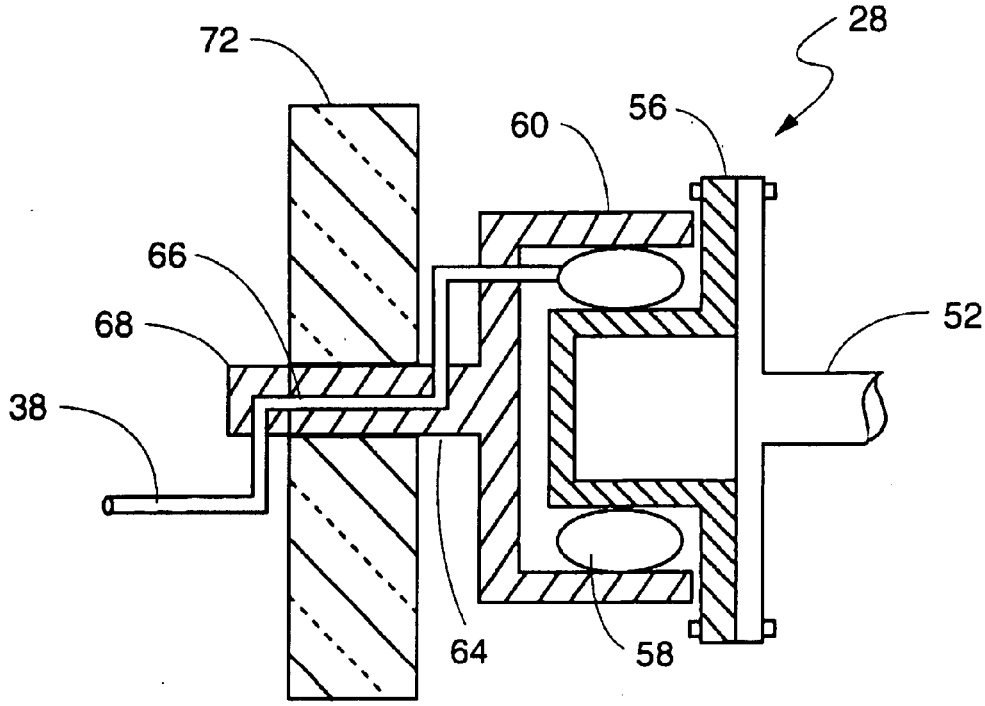
FIG. 3 is a cross-section of a gas-actuated clutch for use in the pumping unit shown in FIG. 1.

FIG. 3 is a cross-section of an exemplary pneumatic clutch 28 for use in the pump assembly 10 shown in FIG. 1. Rotary motion from engine 24 (FIG. 1) is transmitted by shaft 52 to clutch plate 56. Clutch hub 60 engages clutch plate 56 through clutch bladder 58. When clutch bladder 58 is pressurized, clutch hub 60 is connected to clutch plate 56 and the rotary motion of engine 24 is transmitted to shaft 64 to, e.g., flywheel 72 for connecting to crankshaft 16 (FIG. 1) and translating rotary motion into vertical motion. Shaft 64 may also be connected to a gear (not shown) for actuating a gear box (not shown) for increasing the torque to move crank arm 16. Any number of mechanical configurations are known for connecting the rotary output of pneumatic clutch 28 to crankshaft 16.

Clutch bladder 58 is pressurized by supplying a pressurized gas through gas supply line 38 into stationary hub 68 and through axial cavity 66 of shaft 64 to clutch bladder 58. The pressurized gas is preferably natural gas from the adjacent well head, but any source of a compressed gas could be used, such as a compressed air tank or an air compressor powered by natural gas from the well. Stationary hub 68 is connected to shaft 64 for relative rotation therebetween and is sealed to shaft 64 to permit the introduction of pressurized gas into clutch bladder 58. A suitable clutch is sold under the tradename Oil States Clutch, Expanding or Contracting.

Control unit 36 (FIG. 1), thus, connects and exhausts pressurized gas within clutch bladder 58 to intermittently connect clutch plate 56 to clutch hub 60. Pumping assembly 10 then intermittently pumps liquid from well bore 22 so that a hydrocarbon inflow is maintained while greatly reducing the wear on pumping assembly 10 and, more particularly, the piping string and associated components within well bore 22.

The foregoing description of the invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A pumping assembly for maintaining hydrocarbon production from a gas well, comprising:

a pumping assembly for pumping liquid from the gas well;

an engine for driving the pumping assembly;

a pneumatic clutch assembly having a pneumatically inflatable bladder for connecting a hub of the clutch with a clutch plate to transmit rotary motion from the engine to the pump assembly; and a control unit for inflating the bladder when needed to pump liquid from the gas well to maintain hydrocarbon production from the well while enabling the engine to run continuously;

wherein the control unit connects gas from the well to the pneumatic clutch for inflating the bladder.

2. A pumping assembly according to claim 1, wherein the control unit is a timer for periodically actuating the clutch.

3. A pumping assembly according to claim 1, further including means for monitoring a liquid level in the gas well and outputting signal indicative of the liquid level.

4. A pumping assembly according to claim 3, wherein the control unit receives the signal indicative of the liquid level and actuates the clutch to maintain the liquid level below a maximum height to maintain hydrocarbon production from the well.

5. A method for reducing the pumping duty cycle of a pump assembly associated with a pumping gas well comprising the steps of:

continuously running an engine;

connecting the engine with a pump assembly through a clutch assembly having a pneumatically inflatable bladder for connecting a hub of the clutch with a clutch plate to transmit rotary motion from the engine to the pump assembly;

determining a selected event to actuate the clutch to connect the engine with the pump assembly; and providing a pressurized gas on the occurrence of the selected event to inflate the bladder to connect the pump assembly with the engine to remove liquid from the gas well to maintain an inflow of hydrocarbons from a producing formation;

where the pressurized gas is supplied from natural gas exiting the gas well.

6. A method according to claim 5, wherein the selected event is selected from the events consisting of a periodic time interval and a liquid level in the gas well.

7. A method according to claim 5, wherein the selected event is selected from the events consisting of a periodic time interval and a liquid level in the gas well.

8. A method according to claim 5, where the selected event is determined by monitoring the liquid level in the gas well with time and determining a pumping cycle effective to maintain an inflow of hydrocarbons from the producing formation.

9. A method according to claim 5, where the selected event is determined by directly monitoring the level of liquid in the well and actuating the pump assembly to maintain the liquid level between selected elevations to maintain an inflow of hydrocarbons from the producing formation while reducing the pump assembly duty cycle.

* * * * *